US007750545B2

(12) United States Patent
Benedix et al.

(10) Patent No.: US 7,750,545 B2
(45) Date of Patent: Jul. 6, 2010

(54) DOUBLE-SIDED SEALED ELECTRIC LAMP AND METHOD FOR PRODUCTION THEREOF

(75) Inventors: Jens Benedix, Wermelskirchen (DE); Rainer Braun, Wipperfürth (DE); Jörg Thäle, Weißenhorn (DE); Hartmut Wilke, Wipperfürth (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 544 days.

(21) Appl. No.: 10/570,817

(22) PCT Filed: Sep. 14, 2004

(86) PCT No.: PCT/DE2004/002036

§ 371 (c)(1),
(2), (4) Date: Mar. 6, 2006

(87) PCT Pub. No.: WO2005/029529

PCT Pub. Date: Mar. 31, 2005

(65) Prior Publication Data

US 2007/0001576 A1 Jan. 4, 2007

(30) Foreign Application Priority Data

Sep. 16, 2003 (DE) ..... 103 42 801

(51) Int. Cl.
*H01J 5/48* (2006.01)

(52) U.S. Cl. ..... 313/318.03; 313/631; 313/318.01

(58) Field of Classification Search ..... 313/627–643, 313/567, 111–117, 25–27, 318.01–318.09; 439/615, 739; 445/24, 26, 29, 22
See application file for complete search history.

(56) References Cited

U.S. PATENT DOCUMENTS

| | | | | |
|---|---|---|---|---|
| 3,140,417 | A * | 7/1964 | Tietze | 313/256 |
| 4,202,999 | A * | 5/1980 | Holle et al. | 174/50.61 |
| 4,404,491 | A * | 9/1983 | Siaens et al. | 313/318.1 |
| 5,006,757 | A * | 4/1991 | Odagaki | 313/623 |
| 5,932,955 | A * | 8/1999 | Berger et al. | 313/318.02 |
| 2003/0201703 | A1 * | 10/2003 | Horiuchi et al. | 313/113 |

FOREIGN PATENT DOCUMENTS

| | | |
|---|---|---|
| EP | 0 547 683 | 6/1993 |
| EP | 0 780 883 | 6/1997 |
| FR | 1 433 551 | 4/1966 |

* cited by examiner

*Primary Examiner*—Peter J Macchiarolo
*Assistant Examiner*—Donald L Raleigh

(57) ABSTRACT

The oblong bulb (1) of the lamp is sealed at opposing ends by sealing pieces (6; 32), with application of a holder to each end, whereby said holder comprises an electrical contact element (13; 25), electrically connected to a power supply (15; 21), running to the lighting means. The contact element is housed in a tubular extension (11; 22) of the sealing piece and the maximum external diameter of the contact element (13; 25) is loosely matched to the inner diameter of the sleeve.

5 Claims, 6 Drawing Sheets

DOUBLE-SIDED SEALED ELECTRIC LAMP AND METHOD FOR PRODUCTION THEREOF

TECHNICAL FIELD

The invention relates to an electric lamp sealed at two ends and to a method for its production in accordance with the precharacterizing clause of claim 1. It concerns both metal halide lamps and incandescent lamps, such as halogen incandescent lamps.

PRIOR ART

EP 780 883 has already disclosed an electric lamp sealed at two ends and a method for its production, in which two base parts have contact elements which rest in tubular extensions at the end of pinch seals, which have a sealing effect. The contact elements extend transversely with respect to the lamp axis and are surrounded by the tubular extensions in the form of sleeves. They are fixed completely or partially along the circumference of the contact elements. One disadvantage of this is the fact that it is easy for the contact elements to become skew such that they are no longer positioned precisely transversely with respect to the lamp axis and, in addition, the risk of breakage is relatively high. One further disadvantage is the complicated manufacture which requires new machines.

SUMMARY OF THE INVENTION

One object of the present invention is to provide a lamp sealed at two ends in accordance with the precharacterizing clause of claim 1 which has a simple, securely mounted and precisely aligned base. It is a further object to provide a cost-effective base and a corresponding method as well as a base which is particularly well suited for automation.

These objects are achieved by the characterizing features of claim 1. Particularly advantageous embodiments are described in the dependent claims.

The advantage of the present invention consists in the fact that it is possible to completely dispense with the ceramic sleeve material and thus also the cement. The time-consuming baking of the base cement is completely dispensed with. Shaping of the glass base sleeve can in principle be carried out at the same time as the pinch-sealing manufacturing step. It is, however, more suitable to use a separate tube part for the production. Overall, a considerable saving on material costs is achieved compared to ceramic bases (order of magnitude 50%) without the principal manufacturing sequence needing to be substantially changed, on the other hand. The same machines can therefore be used as for ceramic bases, once they have been correspondingly adapted. This is a significant advantage over the concept from EP 780 883.

The electric lamp sealed at two ends comprises, according to the invention, an elongate lamp bulb, which is sealed in a vacuum-tight manner and defines a longitudinal axis. It is equipped at both of its mutually opposing ends with sealing parts, in particular fuse seals or else pinch seals, for example each pinch seal surrounding a pinch foil which connects inner and outer power supply lines to one another. Lamp bases are fitted to each of the outer ends of the sealing parts. Said lamp bases each comprise a sleeve which is formed from the material of the lamp bulb or preferably from a separate part and is attached to the outer end of the seal (fuse seal or pinch seal). This sleeve has an inner and outer diameter, the wall thickness of the sleeve, depending on the type, being of the order of magnitude of approximately one millimeter. A contact element, which is electrically conductively connected to the outer power supply line, rests in the interior of the sleeve, with play. The contact element extends essentially transversely with respect to the lamp axis.

The basic shape of the contact element is a circular disk or another disk-like design, in particular a plate. However, slight deviations from the circular shape are not ruled out. The sleeve also does not need to be precisely cylindrical. Both parts of the base, the sleeve and the contact element, are preferably matched to one another in terms of cross section and are advantageously circular-cylindrical. In this case, the (largest) diameter of the contact element is loosely matched to the inner diameter of the sleeve; it is preferably approximately 85 to 95% of the inner diameter of the sleeve. Fixing the contact element itself in the sleeve is expressly dispensed with, as a result of which the manufacturing speed is increased. This is now possible because the length L of the sleeve is kept very short. It is, in particular, $L \leqq 15$ mm, preferably $L \leqq 10$ mm. For example, L may be 3 to 8 mm. The contact element is advantageously secured against being tilted by sections of the glass sleeve of the base being integrally formed on a neck part or the power supply line at a point directly behind the contact element.

In order to hold the contact element in a stable manner, a power supply line having a diameter of at least 0.4 mm, preferably at least 0.5 mm, is recommended. Typical values are between 0.5 and 0.7 mm. A profile of specifications is thus covered by the following points: the power supply line avoids being bent back, withstands high currents and comes through the pinching operation undamaged.

In another possible embodiment of the contact element, for example an ellipse, the distance between the edge of the disk-like body and its center point, i.e. its radius, changes over the circumference.

The particular advantage of a free contact element is the fact that consideration of the compatibility between the glass material of the sleeve and the metallic material of the contact element no longer has any significance because it is no longer necessary, owing to the lack of contact between them, for the coefficient of thermal expansion of the material of the contact element to be matched to the coefficient of thermal expansion of the bulb material (generally quartz glass). The glass material of the sleeve is in particular similar to the bulb material, but it is possible for lower requirements to be chosen for the purity and optical quality. A suitable material for the contact material is, for example, stainless steel (V2A, in particular also nickel-plated) or primarily nickel, possibly coated, for example silver-plated or gold-plated, or copper (in particular nickel-plated). Conversely, in the case of a separate sleeve, the sleeve's material can be matched in an optimum manner to the material of the contact element, with the result that an integral neck part can also be used.

The outer power supply line, which connects the pinch foil or inner power supply line to the contact element, can in principle be realized in various ways.

A first possibility is for the outer power supply line to be an axially arranged wire. In this case, the contact element advantageously under some circumstances has a loop-like attachment piece (neck part), into which the wire can be inserted. A second variant is for the outer power supply line in the form of a wire to be bent back and for the longitudinal side of the angular piece to be welded to the contact element. Finally, the contact element can also be butt-welded directly to the axial wire of the power supply line.

In particular when part of the outer power supply line is bent back, it is advantageous for the contact element to bulge out towards the power supply line. The angular piece can be effectively welded to this concave curvature.

It has proven favorable for the stability of the contact element in the glass sleeve if at least the edge of the contact element has a thickness of between 1.2 and 1.6 mm, for example 1.4 mm. In one particularly preferred embodiment, this dimensioning applies for the whole contact element.

The production of such a base from glass sleeves integrated on the seal can in principle be incorporated in the conventional production sequence for such lamps, as is described, for example, in EP-A 451 647 (with the aid of a four-jaw pinching machine). In order to produce the base according to the invention, the jaws now each contain an integrated shaping device which shapes not only the pinch seal but also the glass sleeve. In this case, as an intermediate step, the end of the lamp bulb, in particular also the region of the subsequent glass sleeve, is first brought to deformation temperature.

Owing to the surface tension, this results in defined self-deformation of the bulb end such that the tube diameter is constricted there. Owing to the shaping jaws, which are matched to the intended base shape, a seal is now achieved for the bulb by means of the pinching jaws. At the same time, the base geometry is molded, the contact element being held at the correct point by means of a vacuum or by means of tongs. A defined inner diameter of the glass sleeve is achieved by suitably selected processing parameters. Owing to the short sleeve length for the purpose of improving the stability, no special centering parts, as described in EP 780 883, are required.

In particular, the loop-like attachment part and the contact element are produced integrally, anticorrosion steel, tungsten or else molybdenum generally being used as the material. An attachment part is, however, usually not required owing to the short physical length.

In principle, the above concept is suitable for many types of lamps, in particular for discharge lamps or incandescent lamps. It is particularly preferred in lamps without an outer bulb. When an outer bulb is used, said outer bulb can completely or partially surround the discharge vessel. The lamp shafts may be pinch seals or fuse seals.

The contact element is generally in the form of a disk, to be precise usually in the form of a circular disk or an oval.

In order to ensure reliable contact is made, the contact elements are advantageously accommodated in the interior of the sleeve and, in the process, are spaced apart from the outer end of the sleeve by at least 0.5 mm, in particular 1 mm.

In one particularly preferred embodiment, production takes place in a cost-effective manner, as described below. First, a conventional lamp, for example a halogen incandescent lamp with a pinch seal at two ends, is produced, whose bulb is made from quartz glass, the outer power supply lines protruding from the pinch seal. Then, the contact element is fixed to the outer power supply line. In addition, a circular-cylindrical quartz glass tube is provided with a length, which is desirable for the dimensions of the sleeve, of between 3 and 15 mm, typically 5 to 10 mm. This tube is pushed over the contact element and attached to the end of the pinch seal. In this case, the tube is held centrally and its end is moved up to the pinch seal by means of an advancing movement. The connecting region between the tube end and the pinch seal is now heated such that the mutually facing ends of the tube and the pinch seal can be connected to one another and advantageously shaped in the process. During the shaping, preferably in the form of it being integrally formed on the holder of the contact element, the advancing movement of the tube end is adjusted in terms of its relative position with respect to the spherical cap in the base by means of a stop. A suitable heat source is, in particular, a laser beam, preferably defocused, plasma or a flame. The dimensions of the tube in the region of the contact element are in this case maintained, if possible. This makes it possible for suitably selected tubes having precise dimensions and contact elements, which are matched in terms of diameter, to be used with low tolerance.

In one preferred embodiment, the sleeve may be deformed by a defocused laser and a pinching jaw or shaping jaw interacting such that the diameter of the sleeve is further reduced in the region between the contact element and the end of the pinch seal, in particular to an inner diameter of the tube which is smaller than the outer diameter of the spherical cap. In this case, the sleeve preferably bears against the outer power supply line, possibly also against a neck part for the contact element. This stabilizes the contact element against it being tilted. This property is particularly important when inserting the lamp into the lampholder.

One typical application is for metal halide lamps and halogen incandescent lamps.

BRIEF DESCRIPTION OF THE DRAWINGS

The invention will be explained in more detail below with reference to a plurality of exemplary embodiments. In the drawings.

PREFERRED EMBODIMENT OF THE INVENTION

Figure 1A:
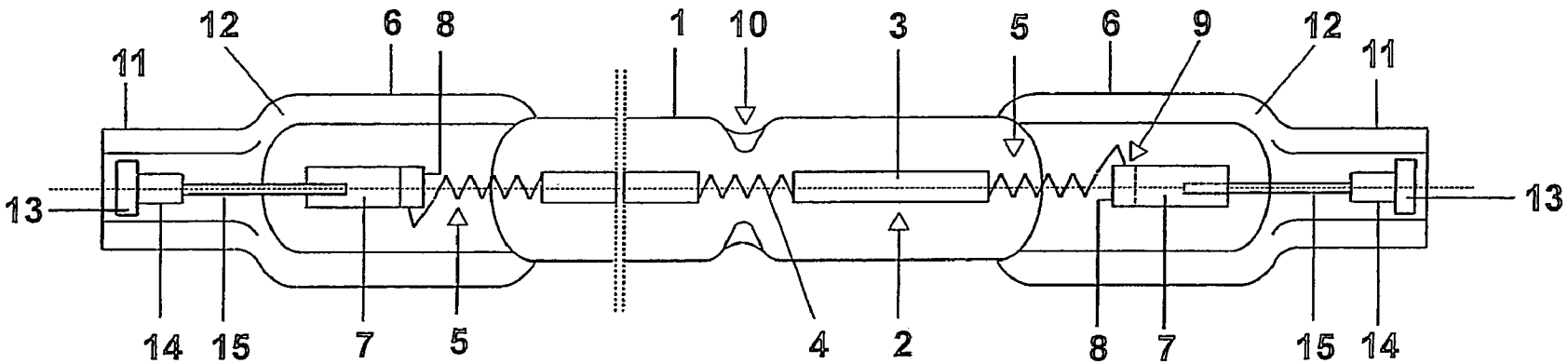
FIG. 1 shows a halogen incandescent lamp in a side view (a) and rotated through 90° (b)
Figure 1B:
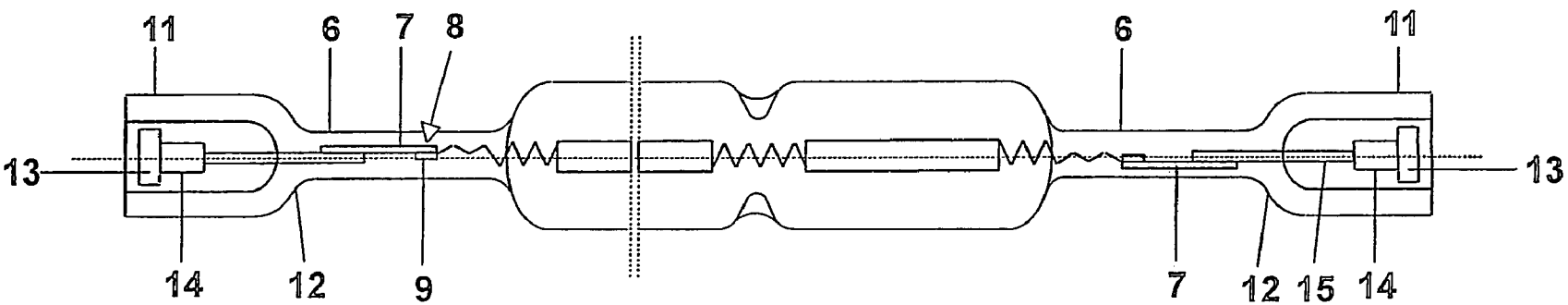

FIG. 1 shows the side view of a halogen incandescent lamp with a pinch seal at two ends, in each case rotated through 90° (FIGS. 1*a* and 1*b*). It comprises a cylindrical bulb 1, in which a luminous element 2 is arranged axially. The luminous element 2 is held in the bulb 1 by means of knobs 10.

The luminous element 2 comprises luminous sections 3 having a small incline which are separated from one another by nonluminous sections 4 having a large incline. The ends 5 of the luminous element also comprise nonluminous sections having a large incline. The ends 5, in their function as an inner power supply line, are embedded directly in the pinch seal 6 and are connected there to a pinch foil 7. That end 8 of the foil 7 which faces the luminous element is bent back within the pinch seal 6, the luminous element end 5 being inserted into the bend 9, and electrical contact thus being produced with the foil 7 purely mechanically.

A tubular glass sleeve 11 having an outer diameter of 7.0 mm and an inner diameter of 5 mm is integrally formed on the outside, in the form of a base, on the pinch seal 6. The sleeve 11 is approximately 7 mm long. It is thus narrower than the broad side of the pinch seal 6, but wider than the narrow side of the pinch seal 6. Correspondingly, a transition zone 12 is located between the pinch seal 6 and the sleeve 11.

A disk-like contact element 13, which is produced from nickel having a thickness of 1.4 mm, is embedded in the sleeve 11 transversely with respect to the lamp axis at a depth of 3 mm from the sleeve end. The contact element 13 is in the form of a circular disk, the radius of the disk 13 being approximately 90% of the radius of the inner diameter of the sleeve 11.

A hollow neck part 14 is attached to the rear of the element 13. A molybdenum wire having a diameter of 0.6 mm is arranged as the outer power supply line 15 between the foil 7 and the element 13 with the neck part 14, said molybdenum wire being welded to the neck part 14.

Figure 2A:
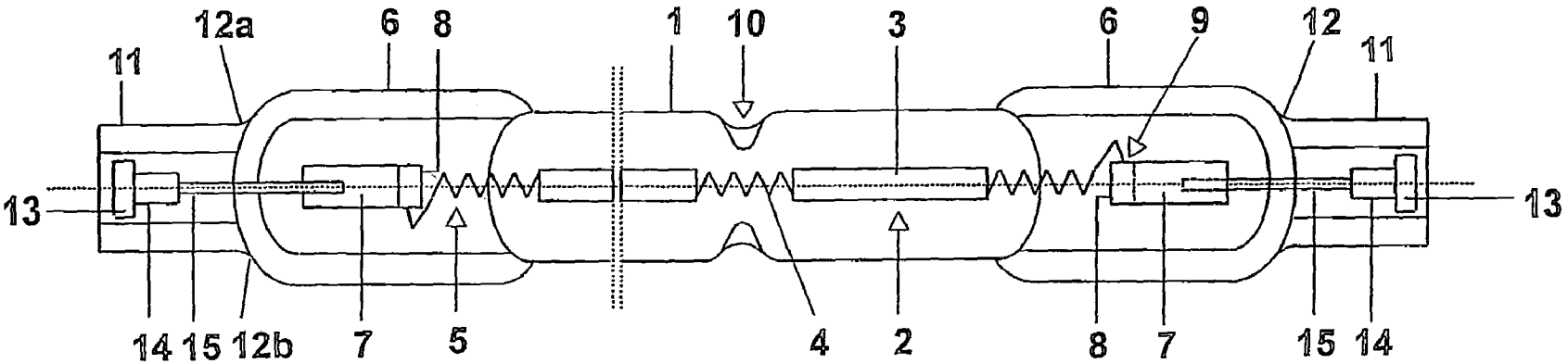
FIG. 2 shows a halogen incandescent lamp in a side view (a) and rotated through 90° (b)
Figure 2B:
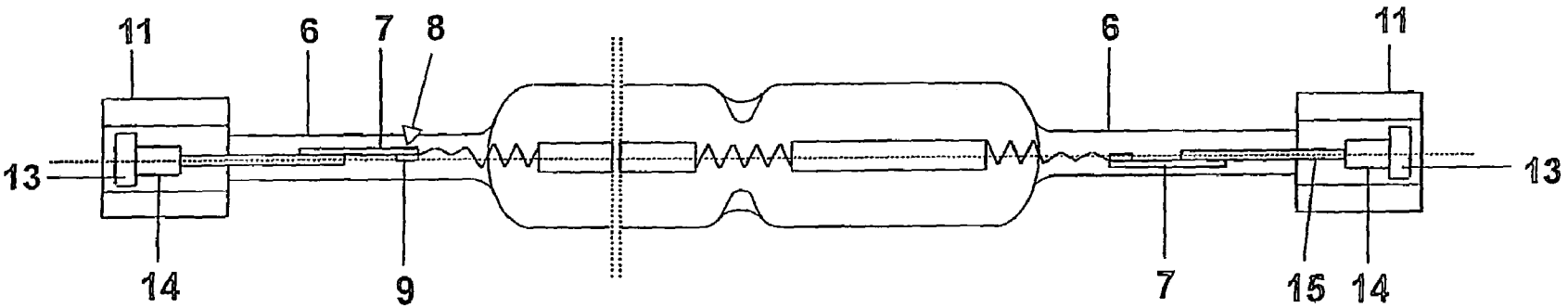

FIG. 2 shows two views (FIGS. 2*a* and 2*b*), rotated through 90°, of a halogen incandescent lamp with a pinch seal at two ends. It comprises a cylindrical bulb 1, in which a luminous element 2 is arranged axially. The luminous element 2 is held in the bulb 1 by means of knobs 10. The bulb is made from high-purity quartz glass.

The luminous element 2 comprises luminous sections 3 which are separated from one another by nonluminous sections 4. The ends 5 of the luminous element also comprise nonluminous sections having a large incline. The ends 5, in their function as an inner power supply line, are embedded directly in the pinch seal 6 and are connected there to a pinch foil 7. That end 8 of the foil 7 which faces the luminous element is bent back within the pinch seal 6, the luminous element end 5 being inserted into the bend 9, and electrical contact thus being produced with the foil 7 purely mechanically. The foil is 2.5 μm thick.

A separate tubular sleeve 11 made from low-quality quartz glass and having an outer diameter of 7.45 mm and an inner diameter of 5 mm is integrally formed on the outside, in the form of a base, on the pinch seal 6. The sleeve 11 is approximately 8 mm long. It is narrower than the broad side of the pinch seal 6, but wider than the narrow side of the pinch seal 6. Correspondingly, there is a transition zone at certain points between the pinch seal 6 and the sleeve 11. It has surprisingly been found that a local transition zone already ensures a secure hold at the two points of contact 12*a* and 12*b* with respect to the pinch seal. This means that it is sufficient during production, once the lamp including the pinch seals and the outwardly protruding power supply lines 15 have been manufactured, to heat the sleeve 11 as an individual component and to form it integrally on the pinch seal 6. Further improved contact is achieved if the end region of the pinch seal 6 is also heated at the same time. Overall, a reliable and permanent two-point adhesion of the sleeve 11 on the pinch seal 6 is thus achieved.

A disk-like contact element 13, which is produced from nickel-plated copper having a thickness of 1.1 mm, is embedded in the sleeve 11 transversely with respect to the lamp axis at a distance of 1 mm (minimum value is 0.5 mm) from the sleeve end. Said disk-like contact element 13 is circular and is often referred to below as a spherical cap.

A hollow neck part 14 is attached to the rear of the element 13. A molybdenum wire having a diameter of 0.6 mm is arranged as the outer power supply line 15 between the foil 7 and the element 13 and is welded to the neck part 14.

FIG. 3 shows two views (FIGS. 3*a* and 3*b*), rotated through 90°, of a further exemplary embodiment of a halogen incandescent lamp with a pinch seal at two ends. Identical technical features have the same reference numerals as in FIG. 2. A separate tubular sleeve 11 made from quartz glass and having an outer diameter of 7.45 mm and an inner diameter of 5 mm is integrally formed on the outside, in the form of a base, on the pinch seal 6. The sleeve 11 is approximately 14 mm long. It is narrower than the broad side of the pinch seal 6, but wider than the narrow side of the pinch seal 6. Correspondingly, a circumferential transition zone 12 is located between the pinch seal 6 and the sleeve 11 and connects the entire edge of the sleeve 11 to the pinch seal 6. Particularly high robustness is thus achieved.

A disk-like contact element 13, which is produced from nickel-plated copper having a thickness of 1.1 mm, is embedded in the sleeve 11 transversely with respect to the lamp axis at a distance of 1 mm (minimum value is 0.5 mm) from the sleeve end.

Figure 3A:
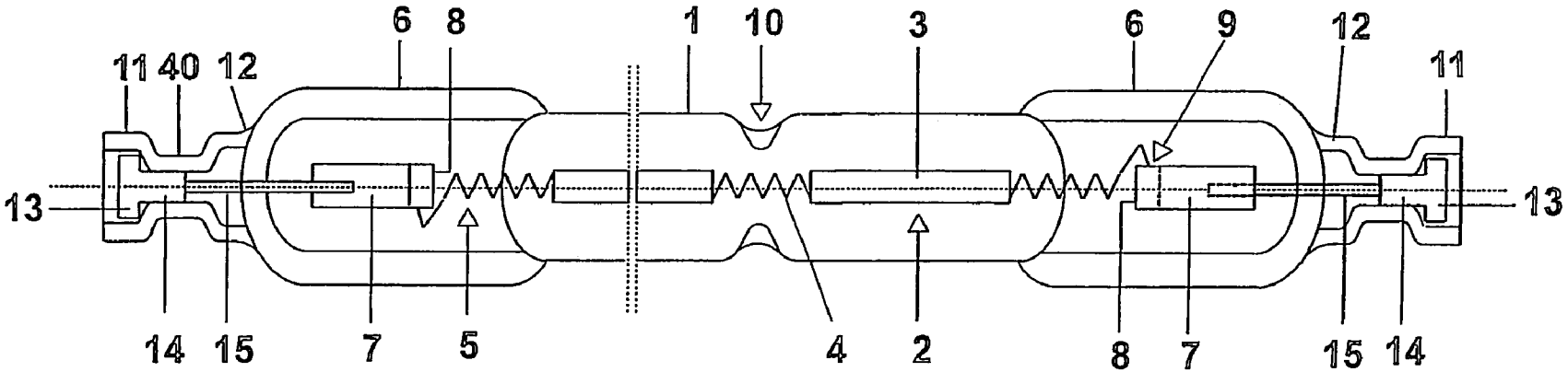
FIG. 3 shows a halogen incandescent lamp in a side view (FIG. 3*a*) and rotated through 90° (FIG. 3*b*) and a contact element in two exemplary embodiments (FIGS. 3*c* and 3*e*) and a further exemplary embodiment of a halogen incandescent lamp in a side view (FIG. 3*d*)
Figure 3B:
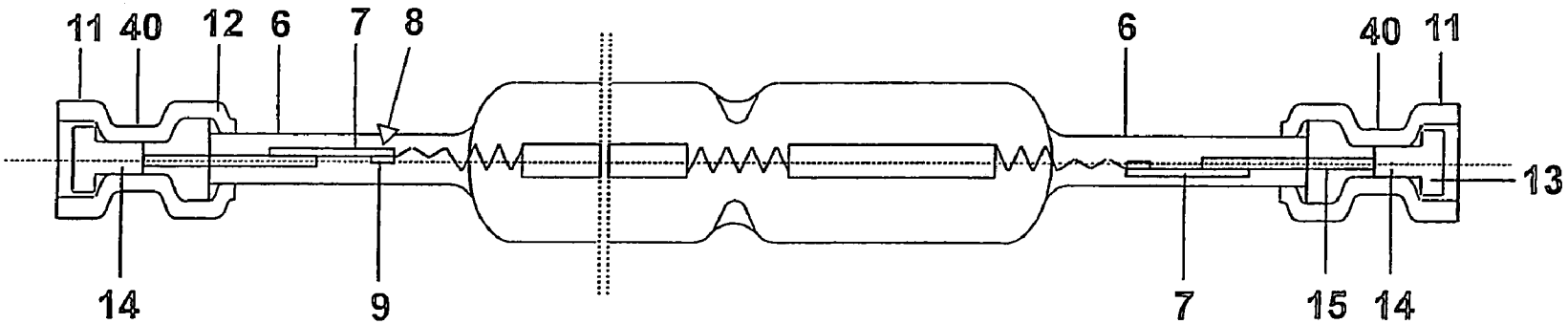
Figure 3C:
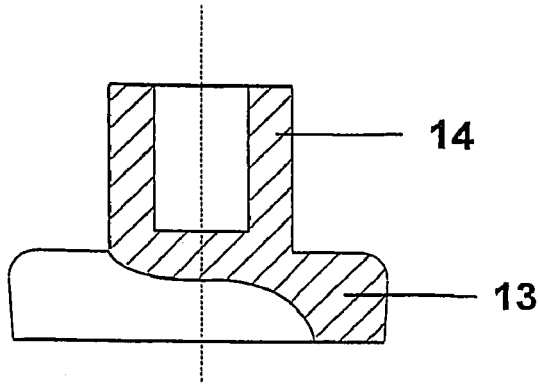

A hollow neck part 14 is integrally formed on the rear of the spherical cap 13, cf. also FIG. 3*c*. A molybdenum wire having a diameter of 0.6 mm is arranged as the outer power supply line 15 between the foil 7 and the spherical cap 13 and is welded to the neck part 14. Particularly effective, stable alignment of the spherical cap 13 is in this case achieved by the fact that the sleeve 11 is heated after or whilst it is fixed to the pinch seal in the region of a section 40 behind the spherical cap 13, and this section 40 is integrally formed on the neck part 14 such that as the constricted section 40 it has a markedly smaller diameter. In this case, no glass/metal connection is produced, with the result that it is not necessary for the coefficients of thermal expansion to be matched to one another. Rather, the section 40 supports the neck part purely mechanically. A gas-tight connection does not take place.

Figure 3D:
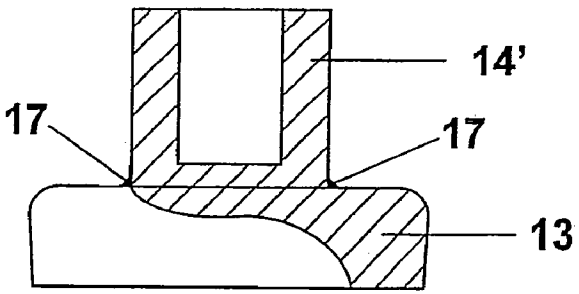

The hollow neck part 14' may also be a separate component, cf. FIG. 3*d*. It is welded or soldered to the plate (17).

Figure 3E:
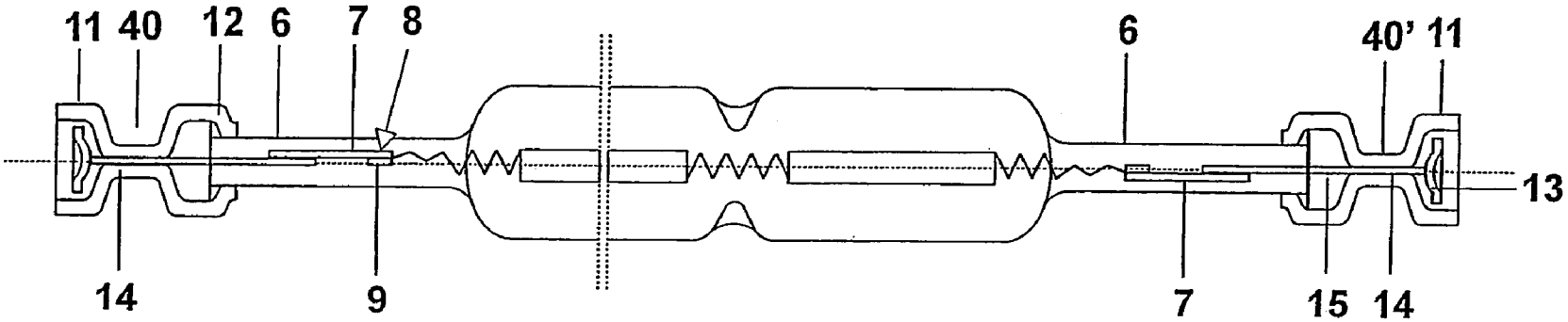

Correspondingly, in the case of a very short neck part or, in particular, when a neck part is dispensed with, the constricted section 40' is pressed directly onto the power supply line, cf. FIG. 3*e*.

Figure 4:
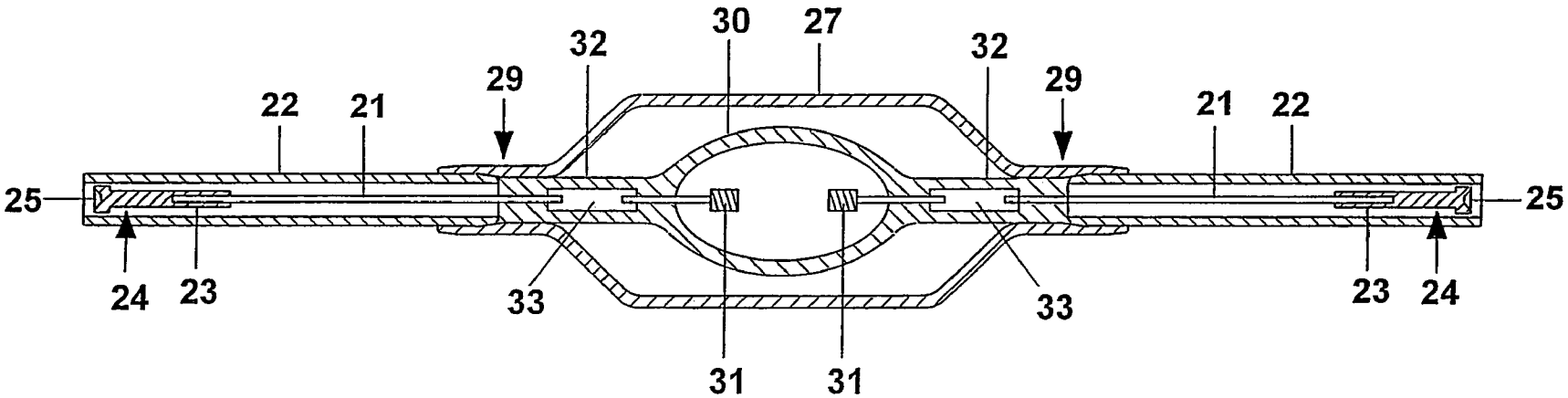
FIG. 4 shows an exemplary embodiment of a metal halide lamp in a side view.

One further exemplary embodiment of a metal halide lamp is shown in FIG. 4. In contrast to FIG. 1, the discharge vessel made from quartz glass and in the form of a barrel-shaped body 30 encloses two electrodes 31 as well as a metal halide filling. The bulb ends are sealed by pinch seals 32, in which foils 33 are embedded. The outer power supply line 21 is passed in a separate tubular sleeve 22, which represents an extension of the discharge vessel, and ends in a socket 23 of an integral base part 24. The base is produced integrally from steel and also comprises a plate-like circular disk 25 as the contact element. The bulbous part of the discharge vessel is surrounded by an outer bulb 27, which is rolled on in the region of the transition between the pinch seal 32 and the sleeve 22 (29).

Figure 5:
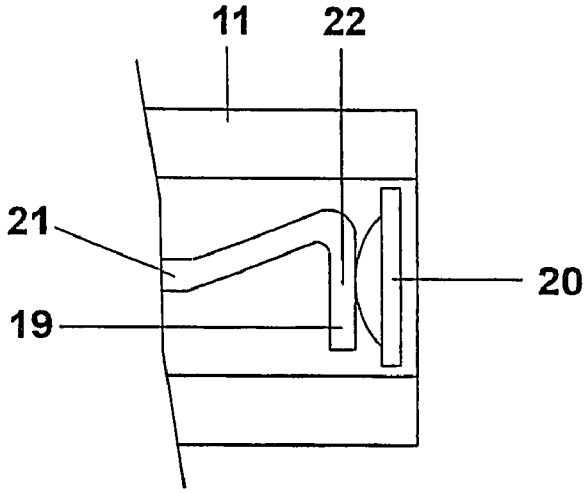
FIG. 5 shows a further exemplary embodiment of a base in a side view.

A further exemplary embodiment of a halogen incandescent lamp is shown in FIG. 5, in detail. Here too, the contact element 20 bulges out in the form of a plate, while the outer power supply line 21 in the form of a wire is bent back within the sleeve 11 (19). The bent-back part 22 is connected with its longitudinal side to the rear of the contact element 20 by means of resistance welding.

Figure 6:
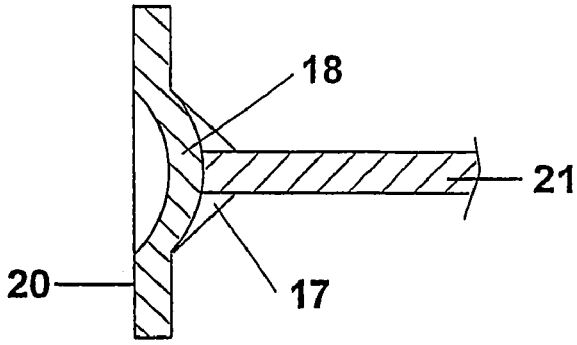
FIG. 6 shows a further exemplary embodiment of a contact element in section.

Instead of a bent-back section, an outer power supply line 21 in the form of a wire may also be butt-welded or soldered (17) directly to the contact element 20 in the region of a bulge 18, cf. FIG. 6.

The invention claimed is:

1. An electric lamp sealed at two ends having an elongate bulb, which is sealed in a vacuum-tight manner, defines a longitudinal axis and is sealed at mutually opposing ends by sealing pads, in each case one base being fitted to one end, the base having an electrical contact element which is electrically conductively connected to a power supply lead leading to a luminous means in the bulb, the contact element being accommodated in a glass sleeve which is connected to the sealing pad, and the contact element being in the form of a plate with exposed surfaces, the plate having a wall thickness of 1.2 to 1.6 mm and forming a void between all of the exposed surfaces and the sleeve.

2. An electric lamp comprising:

an elongate glass bulb with opposed ends, the bulb defining a longitudinal axis of the lamp and being sealed at each end in a vacuum-tight manner with a pinch seal that has an outwardly protruding power supply lead;

a base at each opposed end of the bulb;

the base comprising a tubular glass sleeve that has been formed on the pinch seal at two or more points of contact, the tubular sleeve having a diameter that is narrower than a width of a broad side of the pinch seal and wider than a width of a narrow side of the pinch seal, the power supply lead of the pinch seal outwardly protruding into the tubular sleeve, a disk-like electrical contact element with exposed surfaces, the contact element transverse to the lamp axis, attached to the power supply lead, and accommodated in the sleeve, wherein the contact element forms a void between all of the exposed surfaces and the sleeve.

3. The electric lamp of claim 2 wherein the sleeve is comprised of a different glass than that of the bulb.

4. The electric lamp of claim 2 wherein the maximum outer diameter of the contact element is approximately 85 to 95% of the inner diameter of the sleeve.

5. The electric lamp of claim 2, wherein the sleeve is integrally formed with the pinch seal.

* * * * *